US007735544B2

(12) United States Patent
Kolesnichenko et al.

(10) Patent No.: US 7,735,544 B2
(45) Date of Patent: Jun. 15, 2010

(54) METHOD AND SYSTEM OF ELECTROMAGNETIC STIRRING FOR CONTINUOUS CASTING OF MEDIUM AND HIGH CARBON STEELS

(76) Inventors: Anastasia Kolesnichenko, App. 134.5 Rusanovskiy Boulevard, Kiev (UA) 02154; Anatoly Kolesnichenko, 17 Lockerbie Dr., Valparaiso, IN (US) 46385; Viktoriia V. Buriak, App. 20, 19/2 Serafimovicha Street, Kiev (UA) 02152

( * ) Notice: Subject to any disclaimer, the term of this patent is extended or adjusted under 35 U.S.C. 154(b) by 0 days.

(21) Appl. No.: 12/404,798

(22) Filed: Mar. 16, 2009

(65) Prior Publication Data

US 2009/0229783 A1 Sep. 17, 2009

Related U.S. Application Data

(62) Division of application No. 11/650,803, filed on Jan. 8, 2007, now abandoned.

(51) Int. Cl.
*B22D 11/115* (2006.01)
*B22D 27/02* (2006.01)

(52) U.S. Cl. ..... 164/468; 164/504

(58) Field of Classification Search ..... 164/466, 164/468, 502, 504

See application file for complete search history.

(56) References Cited

U.S. PATENT DOCUMENTS 4,699,205 A 10/1987 Pochmarski et al.
4,834,168 A 5/1989 Nové et al.
4,852,635 A 8/1989 Onishi et al.
4,933,005 A 6/1990 Mulcahy et al.
5,025,852 A 6/1991 Mayrhofer
5,085,265 A 2/1992 Yamamoto et al.
5,279,351 A 1/1994 Metz
5,279,391 A 1/1994 Ward
5,307,863 A 5/1994 Kubota et al.
5,580,543 A 12/1996 Sessler et al.
5,699,850 A 12/1997 Beitelman et al.
5,722,480 A 3/1998 Asai et al.
5,743,324 A 4/1998 Kustreich et al.
5,988,261 A 11/1999 Milorad et al.

(Continued)

FOREIGN PATENT DOCUMENTS

EP 0448113 A2 * 9/1991

(Continued)

*Primary Examiner*—Kuang Lin
(74) *Attorney, Agent, or Firm*—Laurence A. Greenberg; Werner H. Stemer; Ralph E. Locher

(57) ABSTRACT

A method and an apparatus are provided for electromagnetic stirring during a continuous casting process, especially for casting a billet and bloom of medium and high carbon steels. The method and apparatus provide a higher surface quality of the ingot, reduce the entrapping of nonmetallic inclusions into the ingot, and suppress issues regarding central segregation and central porosity. The method provides an improvement in the stirring process from the meniscus to the crater end—and relates to in-mold stirring and stirring in a zone of secondary cooling and up to the crater end. The in-mold stirring is geared towards the suppression of meniscus disturbance, for submerged casting, in particular, the reducing of helical and axial velocity components of the molten steel, the lowering of the initial solidification point to avoid the touching of a shell edge with the slag ring, and a decrease of oscillation marks.

12 Claims, 15 Drawing Sheets

U.S. PATENT DOCUMENTS

| | | | |
|---|---|---|---|
| 5,998,261 | A | 12/1999 | Hofmann et al. |
| 6,003,590 | A | 12/1999 | Pavlicevic et al. |
| 6,024,161 | A | 2/2000 | Fujioka et al. |
| 6,026,713 | A | 2/2000 | Ohmori et al. |
| 6,164,365 | A | 12/2000 | Kunstreich et al. |
| 6,315,030 | B1 | 11/2001 | Poloni et al. |
| 6,386,271 | B1 | 5/2002 | Kawamoto et al. |
| 6,443,219 | B1 | 9/2002 | Sasai et al. |
| 6,530,418 | B2 | 3/2003 | Ebisu et al. |
| 6,699,850 | B2 | 3/2004 | Reszka et al. |

FOREIGN PATENT DOCUMENTS

| | | | | |
|---|---|---|---|---|
| JP | 57195567 | A | * | 12/1982 |
| JP | 62057750 | A | * | 3/1987 |
| JP | 1215439 | A | * | 8/1989 |
| JP | 7-40019 | A | | 2/1995 |
| JP | 7214262 | A | * | 8/1995 |

* cited by examiner

METHOD AND SYSTEM OF ELECTROMAGNETIC STIRRING FOR CONTINUOUS CASTING OF MEDIUM AND HIGH CARBON STEELS

CROSS-REFERENCE TO RELATED APPLICATION

This is a divisional application of application Ser. No. 11/650,803, filed Jan. 8, 2007, now abandoned; the prior application is herewith incorporated by reference in its entirety.

BACKGROUND OF THE INVENTION

Field of the Invention

The invention relates to a continuous casting method and an apparatus to produce medium and high carbon steel billets and blooms having a high quality ingot surface, a reduction of inclusions, low centerline porosity and central segregation.

Surface ingot quality refers to a decrease or elimination of oscillating marks, corner cracking, and pinholes in a surface region of the steel. Central porosity refers to microscopic voids that can be filled with nonmetallic inclusions and form in an interdendritic region in the middle of the final solidification zone. Whereas, central segregation is usually a V-shape (because usually dendrites are declined to ingot axis) that takes place with a periodicity in the middle of the thickness in the final solidification zone, and is generally called V-segregation.

Summarizing, these defects are the major obstacles in the making of quality steel products.

It is known that the liquid steel coming into a mold from a tundish together with an in-mold electromagnetic stirrer creates a hydrodynamic perturbation and especially at the meniscus that is the cause of surface defects and a cause of nonmetallic inclusion entrapping through meniscus distortions and disturbances. The need to decrease meniscus distortion has lead to the building of a supplementary DC electromagnetic unit that is located above the regular electromagnetic stirrer and creates a direct magnetic field for the suppression of a vortex at the meniscus as described in U.S. Pat. No. 4,933,005 to Mulcahy et al. The imposition of a supplementary strong direct magnetic field with an alternating current induced from the alternating magnetic fields of main inductor usually leads to an occurrence, of the strong alternating electromagnetic forces having a frequency of current fed the main coil. Installation of a supplementary three-phase inductor with a rotating magnetic field, having an opposite rotation direction, for braking the liquid steel flow rotation from a main in-mold stirrer (see U.S. Pat. No. 5,699,850) did not lead to the suppression of the meniscus disturbance. On the contrary, the current that was induced inside the ingot and flowed near and along the free surface as a result of action of both—the main and brake inductors—together with the magnetic flux of the brake inductor resulted in a vertical component of the pulsed electromagnetic force and vertical waves at the meniscus similar to solitons, (single waves, which absorb the power of low-sized and high-frequency waves) would periodically appear on the meniscus. Both means—application of direct magnetic field and reverse-rotate alternating magnetic field near meniscus, instead of the expected suppression of the meniscus disturbance, sometimes leads to an increase in the meniscus disturbance.

The steady improvement of continuous casting technology allowed a decrease the initial superheat of casted steels, but it did not eliminate the necessity to have a maximum possible intensity of heat transfer in the mold and therefore, the mold electromagnetic stirrer has remained as means for removing of superheat. The stirring intensity should remain as enough for heat transfer on the one of response area—solidification front being as high as possible, but the problem of meniscus disturbance and ingot surface quality remained a significant problem in steel manufacturing. Therefore, in addition to electromagnetic stirring, U.S. Pat. No. 6,164,365 to S. Kunstreich et al., teaches electromagnetic braking to affect the circulation of the molten metal upon its entry into the continuous casting mold. Because of the requirement to obtain a high surface quality of the ingot, centerline porosity and segregation remained a high priority, the electromagnetic convection (stirring) for obtaining a wide zone of equiaxial crystals was moved to a second position. A braking torque, applied to the part of bulk below meniscus, reduced the common stirring intensity and partially deprived the stirrer of maintaining quality.

Because of the creation of a whirlpool at the meniscus, when the rotational motion of liquid steel is present and the resultant entrapping of mold powder aggregates near the submerged nozzle, affected ingot quality, this lead to looking for other forms of magneto-hydrodynamics (MHD) flow in the molding process of billets and bloom, which would decrease the intensity of the vortex at the meniscus. The vortex further had the inclination to increase itself by its interaction with the incoming fresh molten steel. Early configurations of electromagnetic in-mold stirrers provided a linear inductor with a traveling magnetic field along billet. However, using this type of inductor lead to washing through one of the sides of the solidifying shell and to breakouts. U.S. Pat. No. 5,279,351 teaches the distribution of electromagnetic forces (Lorenz forces) in the liquid part of the ingot that gets two vortexes—internal and external—having opposite directions of rotation. The computation of this magneto-hydrodynamics flow and experiments with low melting metal have shown that the conductive liquid that is confined inside the circle cylinder will obtain usually only one—direct or opposite revolving flow around axis of cylindrical vessel.

However, the wide spectrum of continuous casted steel grades at the numerous steel plants does not allow refuge from in-mold electromagnetic stirring as the main measure for improving metallurgical properties of continuously casted billets and blooms. Therefore, magneto-impulse stirrers appeared, see U.S. Pat. Nos. 5,722,480; 6,003,590; and 6,443,219 B1. Magneto-impulse stirrers generate a strong—up to two Tesla—impulse magnetic field unlike ordinary fields having a strength of 0.07-0.1 Tesla generated usually in the empty mold equipped with rotational asynchronous and linear stirrers. Pulse magnetic fields generates by strong—up to 150 kA—pulse currents, passing directly through the copper walls of the mold or supplied to coils surrounding mold. Instead of rotary movement in the liquid part of the ingot, the magneto-impulse stirrer for submerged casting provided pulse body electromagnetic forces on the level of amplitude 10 ton/m.sup.3, which lead to strong vibrations of the solidified steel shell and mold walls, resulting in a decrease in the curvature of the meniscus edges and, therefore, prevented the touching of the shell edge to the solid slag ring at the mold walls, located above meniscus. Therefore oscillating marks are eliminated. Moreover, the controlled vibration of the solid-liquid interface and the very intensive non stationery flow of the base steel solution between the growing dendrites given a sufficient increase of heat and mass transfer directly at the surface of solidification and a decrease in superheat resulted in decreased meniscus disturbances. However, the necessity to use expensive assembly molds and the extra expense of a pulse power supplies resulted in market failure of this remarkable stirring technology.

Thus, the existing systems of electromagnetic in-mold stirring do not allow a simultaneously solving of the problems of greater quality for cast metal as regards its surface quality or state and its internal properties.

Another problem of casting quality is the problem of porosity, segregation and shrinkage inside the casted ingot.

The ability of in-mold rotational stirring for suppression of macro-segregation and micro-segregation has changed as result of careful investigation of in-mold stirrer workability. Tests of rotational stirring of low melting metals in long vessels and the development of mathematical 3D models has shown that viscous friction at the interface is strong enough to suppress the rotation velocity of the melt practically to zero as it traverses down the casting stream of distances equal to 4-5 times the hydraulic diameters of the mold. The early opinion concern appearance inside the liquid portion of the ingot of numerous centers of solidification as result of braking the growing dendrites due to the rotational motion of the molten steel and the spreading of dendrites chips in unsolidified portion of ingot was not right because any force, including hydrodynamic, existing inside liquid part of the ingot, is not enough for braking of steel monocrystals nevertheless the temperature of it is close to melting point. Thus, the rotational motion of the liquid steel as an action of in-mold stirrer, spreads downstream of the mold just on the above-mentioned distance of 4-5 mold diameters and therefore, the influence of in-mold stirrer on the intensity of center segregation was only indirect—via much intensive cooling of melt inside the mold. When the in-mold electromagnetic stirrer can produce the pressure waves similar to hydraulic shock—the opportunity to get the pulse motion of liquid steel along the solidus-liquidus interface occurs. This factor together with spreading of action of line/final electromagnetic stirrer from the mold up to the crater bottom as a means for creation of intense heat and mass transfer on the solidus-liquidus interface and elimination of conditions for development of segregation and porosity. Unfortunately, this result could not be obtained by employing rotational line/final stirrers, which could provide only local rotational stirring and has shown the same intensive attenuation rotation like in-mold stirring. So, the necessary available stirring intensity by employing rotational line/final stirrers could be obtained only at the top zone of secondary cooling, where the thickness of solidified part of ingot equals not more then 30% of the equivalent radius. The stirring efficiency was low especially on the final stages of ingot solidification, even with a low current frequency (14-20 Hz) and an extra high power consumption of the stirrer—about one megawatt, when the ingot froze more then half of the radius. An attempt to increase the stirring intensity in the zone of secondary cooling through forcing of the stirrer was not successful because on the one hand the after effect of the rotate stirrer has spread on the distance lower then the 4-5 billet/bloom caliber. Right here, where the stirring affects are practically absence, the temperature non-uniformity on the interface increases and the conditions of segregation developed. On the other hand, the action of the next electromagnetic stirrer, which was installed downstream, lead to the washing out of carbon from the inter-dendrite space and a white band occurred. Therefore, the stirring intensity has to be strength limited for the line stirrer, as suggested, for example, in U.S. Pat. No. 4,852,635.

So, for the prevention of centerline segregation and porosity the stirring needs to occur—from the beginning of solidification up to crater end, where the conventional asynchronous stirrers can be effective if they number more than 4-5. The cause of low stirring efficiency of asynchronous stirrers (500 W of mechanical energy for stirring of liquid steel instead of consumed 380 kW full power) are due to the properties of any kind of asynchronous motors used as stirrer, namely, a strong magnetic flux leakage between magnetic core poles, and zero electromagnetic forces in the ingot central region—because the induced current equals to zero at the geometrical ingot center.

Moreover, in asynchronous stirrers electromagnetic forces are practically absent in the mushy zone when a diameter of the mushy zone is lower than 60 mm by any magnetic flux frequency or any level of fed power.

Linear motors with a traveling cross magnetic flux allows the introduction of the induced current and the electromagnetic forces in the ingot center but, nevertheless, the level of these forces is not enough for stirring because the magnetic flux leakage is so strong: the magnetic flux tries to avoid the ingot (billet and bloom), and less then 25% of the magnetic flux can penetrate into ingot even at a comparatively low frequency of 15 Hz. The maximum electromagnetic body force that could appear in the ingot center in this case cannot be more than 50-80 N/m.sup.3 which is not enough for obtaining a liquid steel motion in the developed mushy-zone, need 1000 times more.

Taking in consideration the low efficiency of linear and asynchronous motors as stirrers for continuous casting of steels, U.S. Pat. No. 6,530,418 B2 suggests to use a superconductive DC magnetic system and direct passing of strong direct current—more then 3.500 kA for obtaining motion in the mushy zone along the ingot axis and lice by soft reduction, for the creation of strong pressure, which would allow the elimination porosity and segregation problems. Unfortunately, the use of electromagnetic stirring systems with superconductive magnets are not presently economically viable due to the extreme equipment prices.

So, existing induction motors cannot create the necessary electromagnetic forces that will provide the smooth stirring downstream of the mold completely up to crater end and at the same time move the semi-liquid metal in the mushy-zone close to the crater for prevention of segregation and porosity.

SUMMARY OF THE INVENTION

It is therefore an object of the present invention to eliminate the above-mentioned drawbacks or problems of the conventional methods in electromagnetic stirring in continuous steel casting processes in which un-solidified portions of a continuous casting strand is stirred electromagnetically by a magnetic field induced by alternating current, flowing through coils of the in-mold and line/final stirrer inductors.

With the foregoing and other objects in view there is provided, in accordance with the invention a method of electromagnetic stirring of molten metal in an unsolidified portion of a continuously cast strand of an ingot. The method includes applying an alternating poly-harmonic current to at least four coils of an in-mold stirrer and supplying the alternating poly-harmonic current with three frequency components, including a first frequency component $f_1$=3.0-6.5 Hz, a second frequency component $f_2$=13-20 Hz, and a third frequency component $f_3=0.5\ f_{intr}$, where $f_{intr}$ is an intrinsic frequency of the ingot with a liquid portion inside and having a range 0.9-1.2 Hz. A ratio of current amplitudes is set by the following equations:

(a frequency current amplitude of $f_2$)/(a frequency current amplitude of $f_1$)=0.5-0.75; and (a frequency current amplitude of $f_3$)/(the frequency current amplitude of $f_1$)=0.2-2.0.

A current of the third frequency component $f_3$=0.5 $f_{intr}$ creates a pressure pulsation with a frequency equal to the intrinsic frequency of melt oscillation in the liquid portion of the ingot. An oscillating pressure spreads along the ingot as acoustic waves that generate a pulse flow at a solidification front. A current of the first frequency component $f_1$ is a base current and sets the base current in dependence on a size of an ingot cross section for inducing a stirring torque inside the in-mold stirrer for rotation stirring. A current of the second frequency $f_2$ is provided for reducing a meniscus disturbance, for reducing particle entrapment into the ingot through the meniscus, and for decreasing oscillating marks on the ingot.

More particularly, it is an object of invention to provide a method of electromagnetic in-mold stirring, which is based on the edge effect. The in-mold stirrer uses a magnetic core for developing different magnetic flux frequencies or frequency components and especially when a poly-frequency magnetic flux is created in an electromagnet by passing through its winding a current with different frequency components, aiming to brake the meniscus rotation and disturbance, to decrease or even eliminate oscillation marks, and to decrease the entrapping of nonmetallic inclusions into ingot through the meniscus.

It is a further object of the invention to employ a method of electromagnetic in-mold stirring, which provides for the oscillation of magnetic pressure directly in the liquid steel located in the mold, resulting in the spreading of pressure waves along the liquid portion of the ingot, and, further resulting, in the occurrence of force convection in all liquid portions of the steel—from the bottom of the mold all the way to the crater bottom.

A further object of the invention is to provide a method of electromagnetic stirring downstream of the mold, which can intensify the heat-mass transfer at the solidus-liquidus interface and directly in the interdendritic space for maintaining uniform melt temperatures to prevent the conditions for creating microsegregation in the interdendritic zone and to prevent the growing of columnar crystals, and, simultaneously, to generate strong stirring forces in the mushy zone close to the crater end, where the intensity of pressure waves is attenuated sufficiently.

According to the invention, there is also provided a method and apparatus of electromagnetically stirring molten metal in a solidified portion of the continuously cast ingot from the mold bottom all the way to the bottom crater and especially on the solidus-liquidus interface by inducing an alternating current along the ingot with two line/final inductor-stirrers and the creation of a stirring zone between these stirrers.

The method and apparatus generate in both line and final stirrers two magnetic fluxes in one rectangular-shaped magnetic core, which surrounds the continuously cast ingot. Both magnetic fluxes are generated from three coils. One of the coils having one or two section is installed around one or two of four sides of the rectangular magnetic core. This coil generates the magnetic flux flowing in the magnetic core around billet and generate strong longitudinal current in the billet. Two further coils, each having a saddle-shape, are installed inside the orifice of magnetic core in a gap between the cast strand and an internal surface of the magnetic core. These coils generate the revolving, cross relative billet magnetic flux. All coils are fed with three alternating currents, having a phase shift of .phi.=120.degree. So, all coils generate the complete magnetic flux, having helical and revolving radial components to the ingot axis. A Scott-connection of the coils allows a three phase current system (phase shift 120.degree.) for generating a two-phase system of magnetic fluxes, having a phase shift close to 90.degree. The invention further comprises providing a unit with a rectangular ferromagnetic core surrounding the ingot for containing the first pulsed magnetic field part around the ingot and preventing magnetic flux leakage avoiding the ingot.

Other features which are considered as characteristic for the invention are set forth in the appended claims.

Although the invention is illustrated and described herein as embodied in a method and a system of electromagnetic stirring for continuous casting of medium and high carbon steels, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIGS. 10A and 10B are graphs explaining the effect of ingot grounding on the casting arc and a change of the distribution of: FIG. 10A—current density in the ingot, FIG. 10B—electromagnetic force density in the ingot;

DESCRIPTION OF THE PREFERRED EMBODIMENTS

Figure 1:
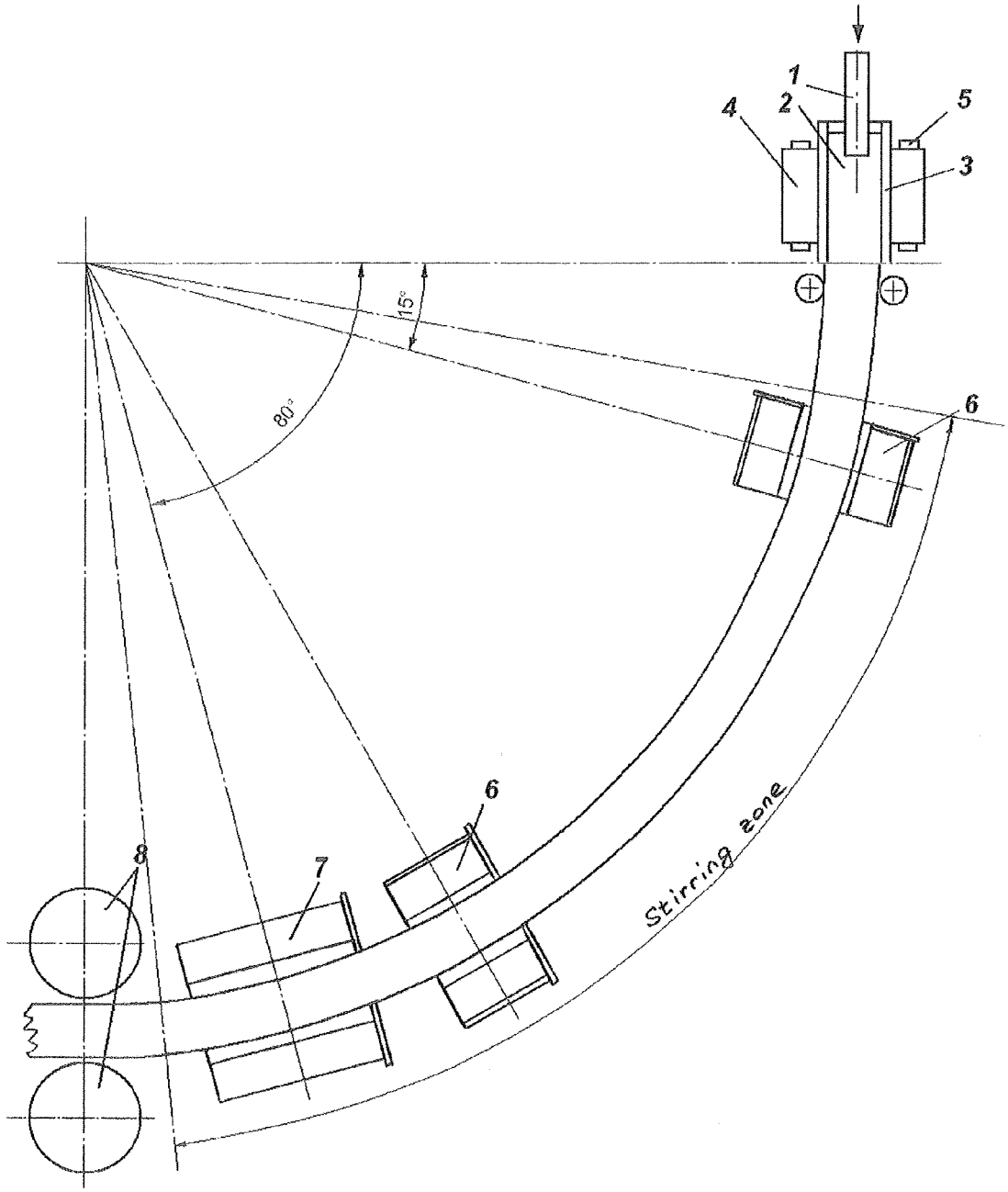
FIG. 1 is an illustration of an electromagnetic stirring system with an in-mold stirrer and line/final stirrers each with magnetic systems according to the invention.
Figures 2A, 2B:
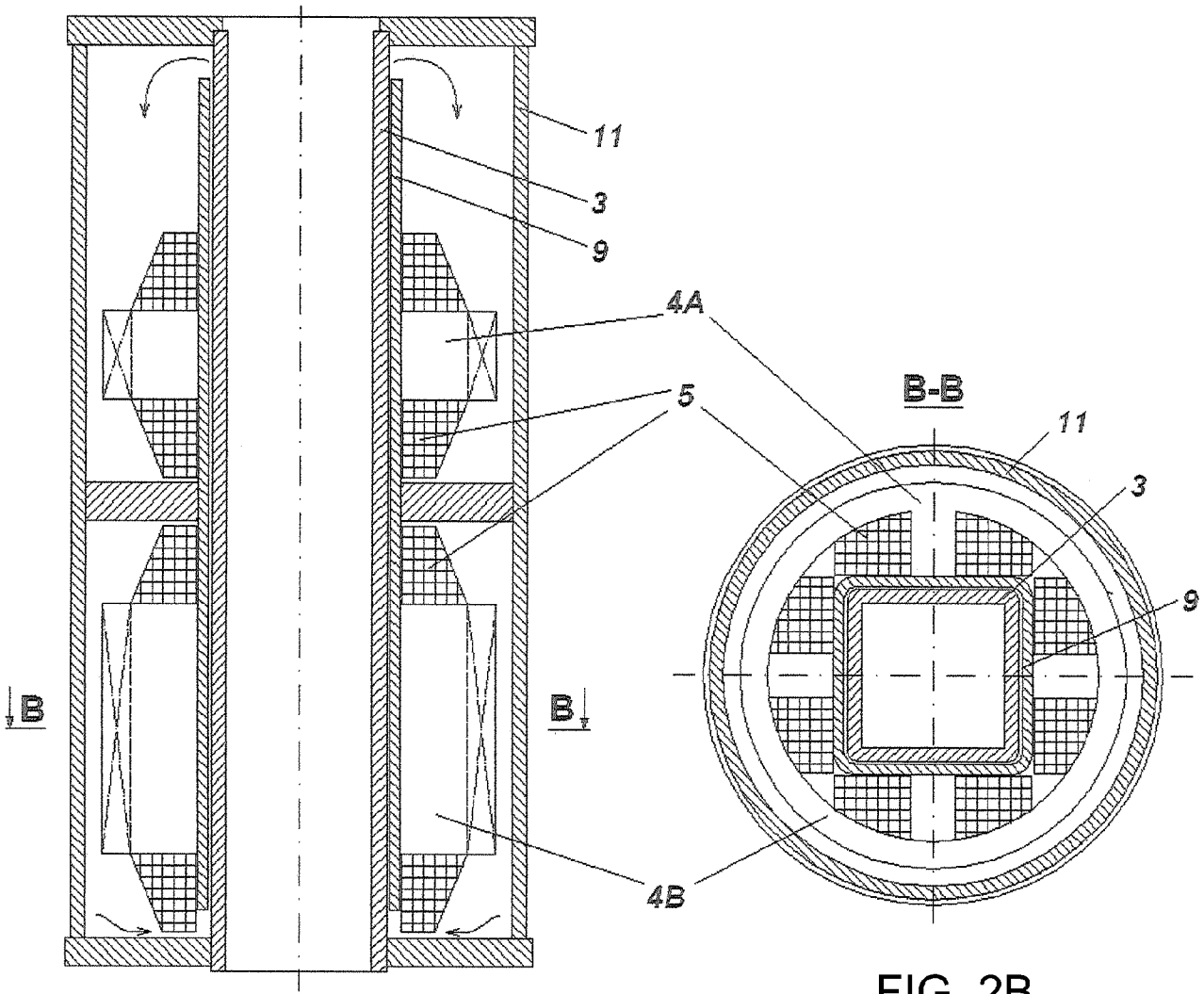
FIGS. 2A and 2B are an example of diagrammatic, sectional views of the electromagnetic in-mold stirrer, which is supplied with alternating poly-frequency currents according to the invention.
Figure 3A:
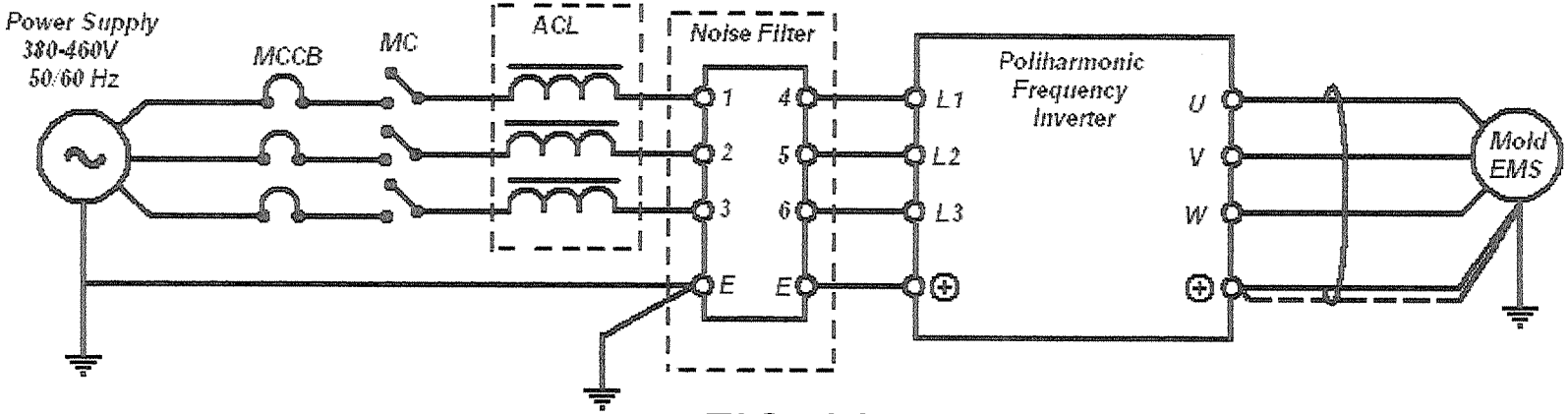
FIGS. 3A and 3B are schematic diagrams of an electrical power feed for the in-mold stirrer.
Figure 3B:
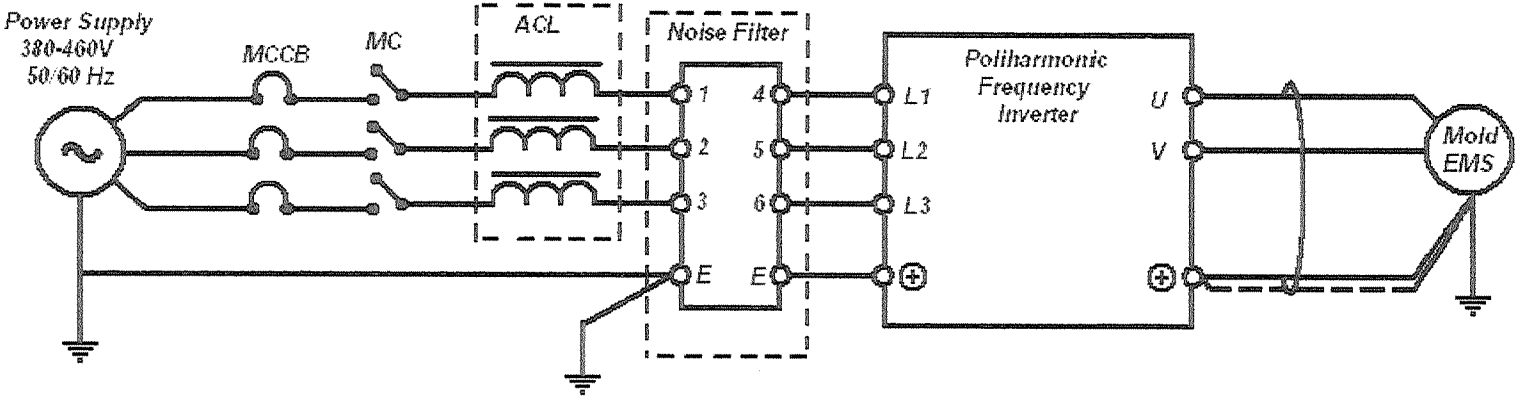

Referring now to the figures of the drawing in detail and first, particularly, to FIG. 1 thereof, there is shown an electromagnetic stirring system which includes an in-mold stirrer 4 and one or two line/final electromagnetic stirrers 6, 7 that are located downstream of the in-mold stirrer 4. The in-mold electromagnetic stirrer 4 integrated into a mold 3 or could locate outside mold, and the mold 3 receives through a submerged nozzle 1 or by free jet, liquid steel 2 into the mold copper crystallizer 3. The in-mold electromagnetic stirrer 4 could be any kind, could be formed of one or, as best shown in FIGS. 2A and 2B, of two—one upper and one lower four-pole or six-pole waterproof magnetic cores 4A such as inductors 4A. One or both upper and lower inductors 4A of the in-mold stirrer 4 are connected to a frequency inverter which is shown in FIG. 3. Each pole of the magnetic cores 4A is surrounded by one coil 5, formed of a waterproof and flexible winding. The upper and lower magnetic cores 4A surround a baffle 9 that is disposed around the copper crystallizer or mold 3. The connection of the coils 5 could be like in classical rotational stirrer or could provides the electrical joining of the coils 5 of the upper magnetic core 4A with the coils 5 of the lower magnetic core 4A with a space shift of 90.degree. Therefore, the same current that flows in the upper coil No. 1, flows in the lower coil No. 2 or No. 4, that is the upper coil No. 1 is shifted relative to the lower coils No. 2 or No. 4 by 90.degree.

The above defined electric connection of the windings of the upper and lower magnetic core of the in-mold electromagnetic stirrer 4 in accordance with the invention are determined from the standpoint of the appearance of an axial component of the electromagnetic force that can generate pressure waves, spreading outside the stirrer 4 into a liquid part of the billet 2.

According to the in-mold electromagnetic stirring method of the invention, an alternating multi-frequency three-phase or two-phase current to be applied to a set of coils to the asynchronous rotation stirrer is in the frequency range of 1.0-20.0 Hz and a ratio of current amplitudes (I low/I high) is in range 0.2-5.0, for all kinds and sizes of billet or bloom during casting. The three-phase or two-phase currents of different frequency components have a different phase sequence. It suppresses the rotating velocity of the melt on the meniscus and suppresses the vertical downward velocity components at the meniscus for preventing the entrapment of nonmetallic inclusions.

The above-defined frequencies of current-components for feeding to the in-mold electromagnetic stirrer in accordance with invention are determined from the standpoint of:

a) braking of the revolving electromagnetic torque at the meniscus; b) suppression of vertical components of the molten steel velocity at the meniscus for preventing the entrapment of nonmetallic inclusions; c) generation of short-wave vibration of meniscus edges for increasing mold powder access into gaps between the ingot and mold walls; and d) generation of Joule heating sources on the meniscus edges especially for lowering the point of initial solidification and preventing a touching of the steel with a solid slag ring formed above the meniscus during casting; e) generation of pulse magnetic pressure with frequency equals to intrinsic frequency of acoustic waves spreading in the liquid portion of continuously casted ingot.

All of the above-mentioned points lead to better surface quality and internal quality of the ingot.

Figure 4:
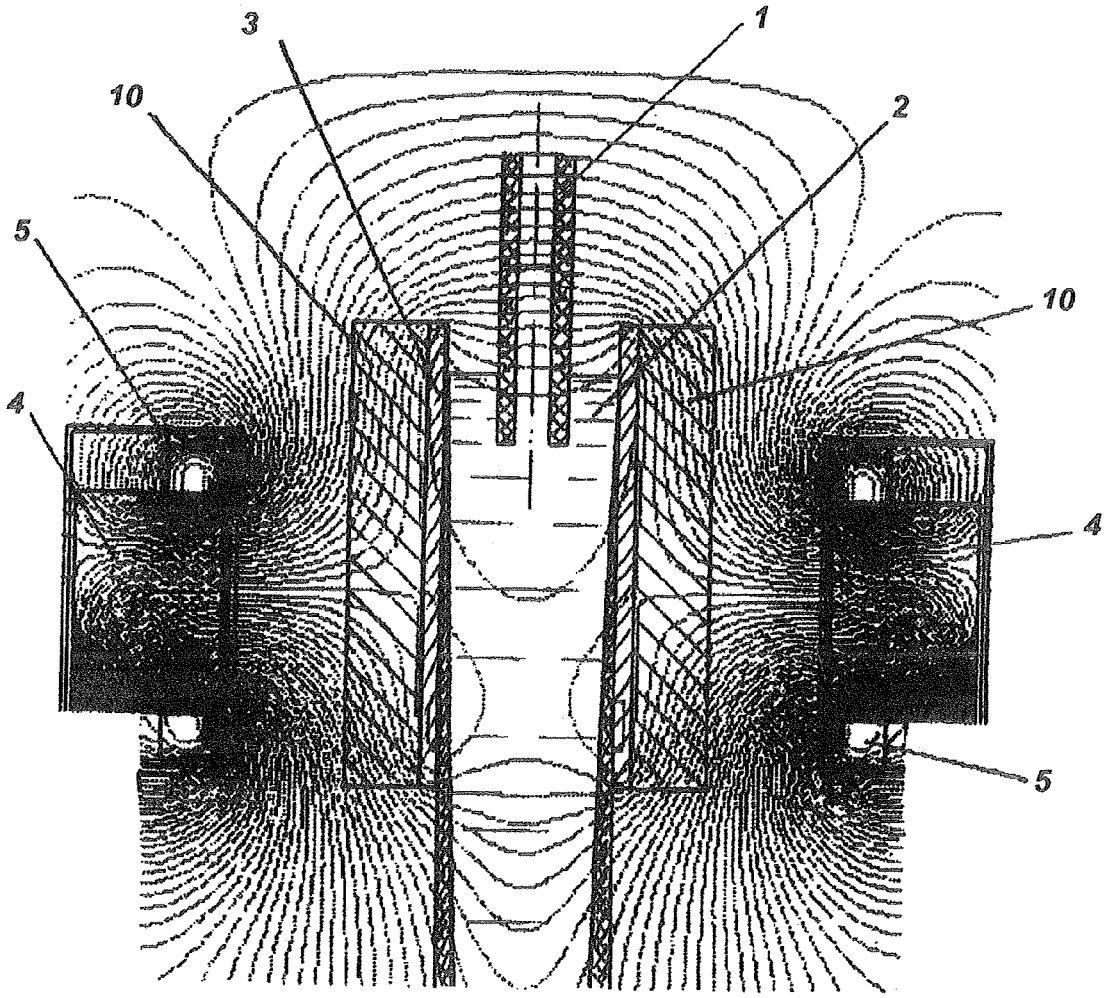
FIG. 4 is an illustration of edge effect when the magnetic flux avoiding the mold penetrates into molten steel through meniscus.
Figure 5A:
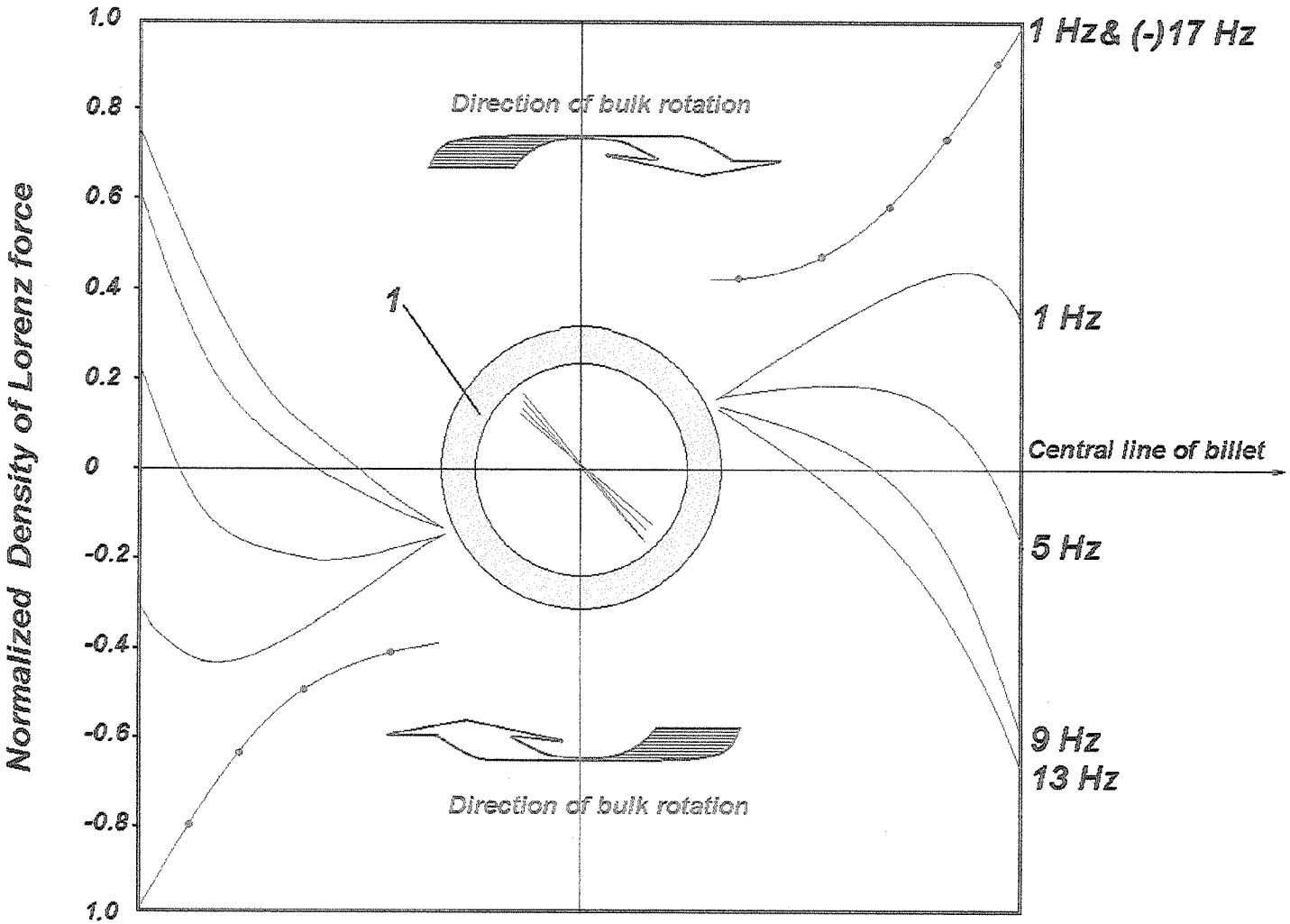
FIGS. 5A and 5B are schematic diagrams for demonstrating a helical component of electromagnetic forces along central line of billet that act near the meniscus and on the middle of lower magnetic core when the edge effect develops by different frequencies that fed the coils of stirrer.

Upon the passing of the alternating multi-frequency current of the above-defined ranges through the exciting coils 5 of the in-mold electromagnetic stirrer 4 shown in FIGS. 1 and 2, the multi-frequency magnetic field, which is induced by the exciting coils, penetrates through the crystallizer or mold 3 into the ingot with different intensities: the low frequency magnetic flux (3.0-6.5 Hz,) penetrates more intensive, and the high frequency magnetic flux component (13-20 Hz) undergo a magnetic resistance of the copper mold 3, and try to avoid the mold above the meniscus and is best shown in FIG. 4. Therefore, the magnetic flux of the high frequency component concentrates at the meniscus edges, penetrates downward into the ingot through the meniscus and creates a reverse braking electromagnetic forces or torque, which is shown in FIG. 5A, due to the current of the high frequency component having a reverse phases sequence comparatively with the currents of the low frequency component.

Figure 6:
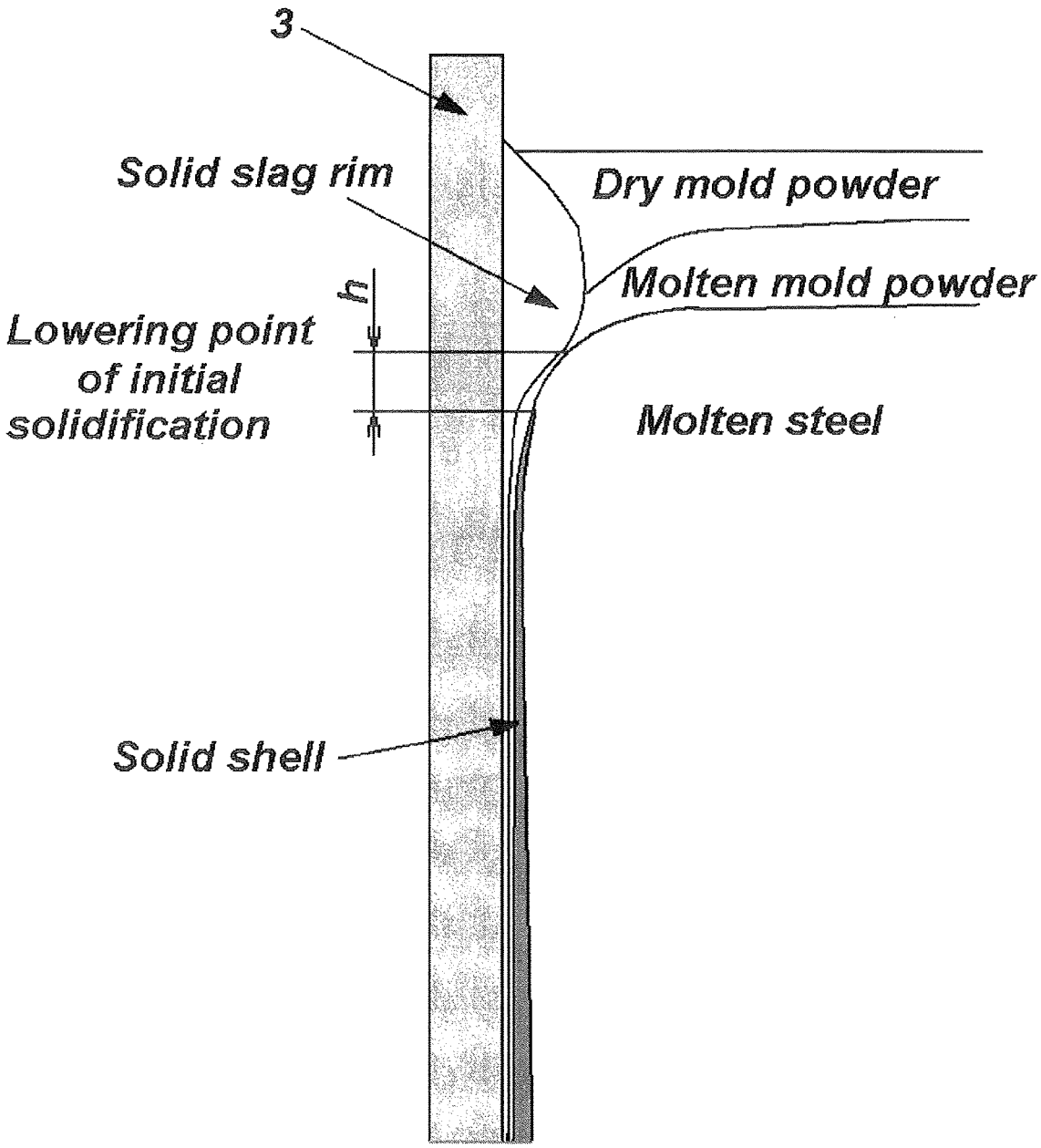
FIG. 6 is a diagrammatic, partial sectional view of a part of the mold during a casting process for explaining a change of position of a point of initial solidification by action of a magnetic field of a higher frequency component.
Figure 7:
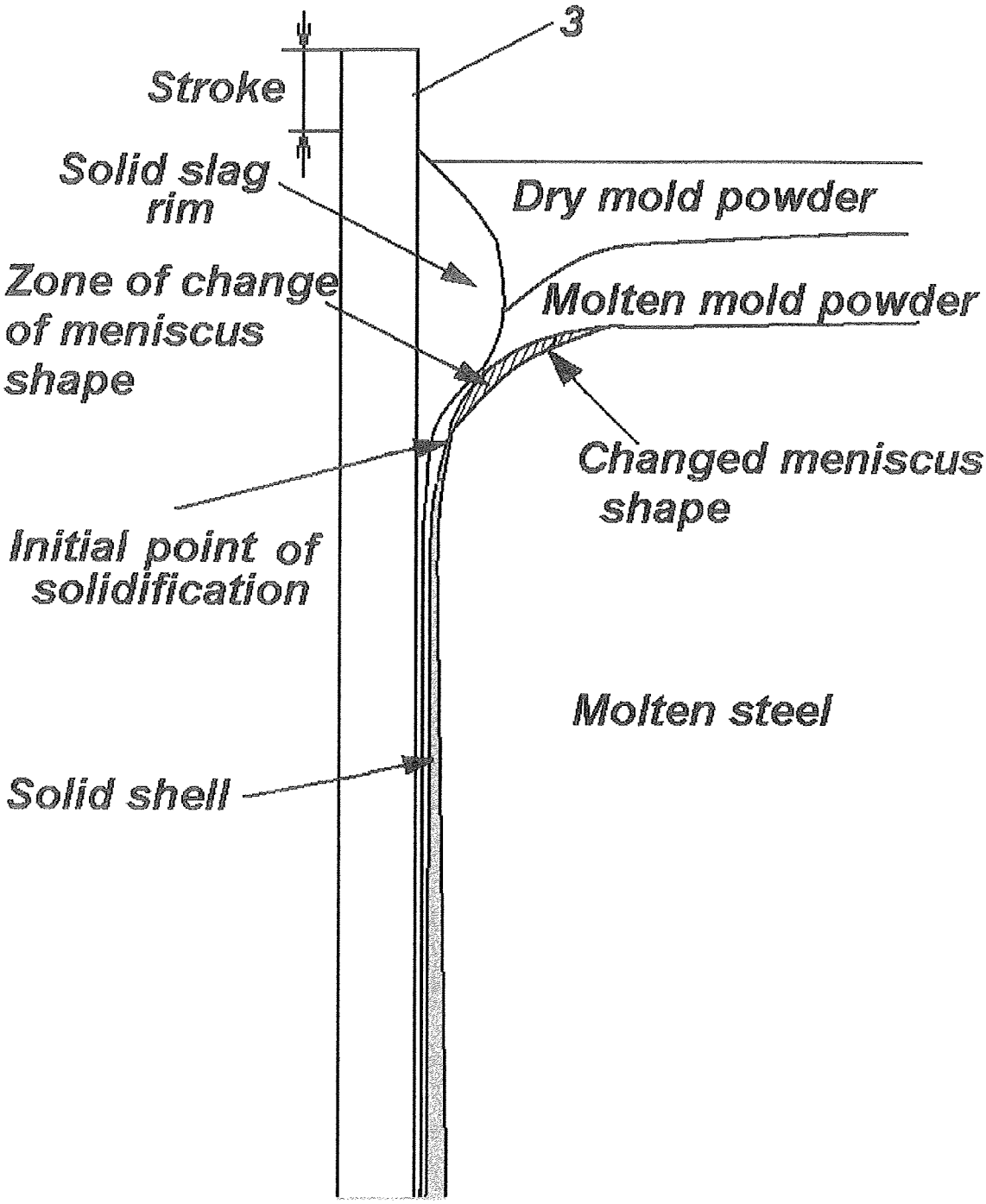
FIG. 7 is a diagrammatic, partial section view of a part of the mold for demonstrating the effects of radial electromagnetic forces that act near on the meniscus and change the shape of meniscus edge.

At the same time, the interaction of the high frequency induced current components that concentrate on the meniscus edges, with the low frequency magnetic field component, which exists here, creates the electromagnetic force that leads to vibration of the meniscus edges and increases the molten mold powder inflow into the gap between the mold and the ingot walls especially on the billet corners (if the billet is rectangular). The increased mold powder flow into the gap between the billet and the mold wall, which increases the heat resistance in the slag layer between the mold and the ingot—on the one hand, and a concentration of electromagnetic power on the meniscus edges and generate here the Joule heating—on the other hand—leads to partial melting of shell edges and a lowering of the point of initial solidification of the ingot. During the submerged casting, the edge of the initial solidification moves down a distance h mm, which is shown in FIGS. 6 and 7 and does not touch the slag rim and therefore oscillation marks decrease or disappear.

The intensity of low frequency magnetic field (3.0-6.5 Hz,) and the main electromagnetic average torque remain on the exciting level and the stirring intensity does not change because the braking torque is applied to a comparatively small volume of the cast steel.

Figure 8:
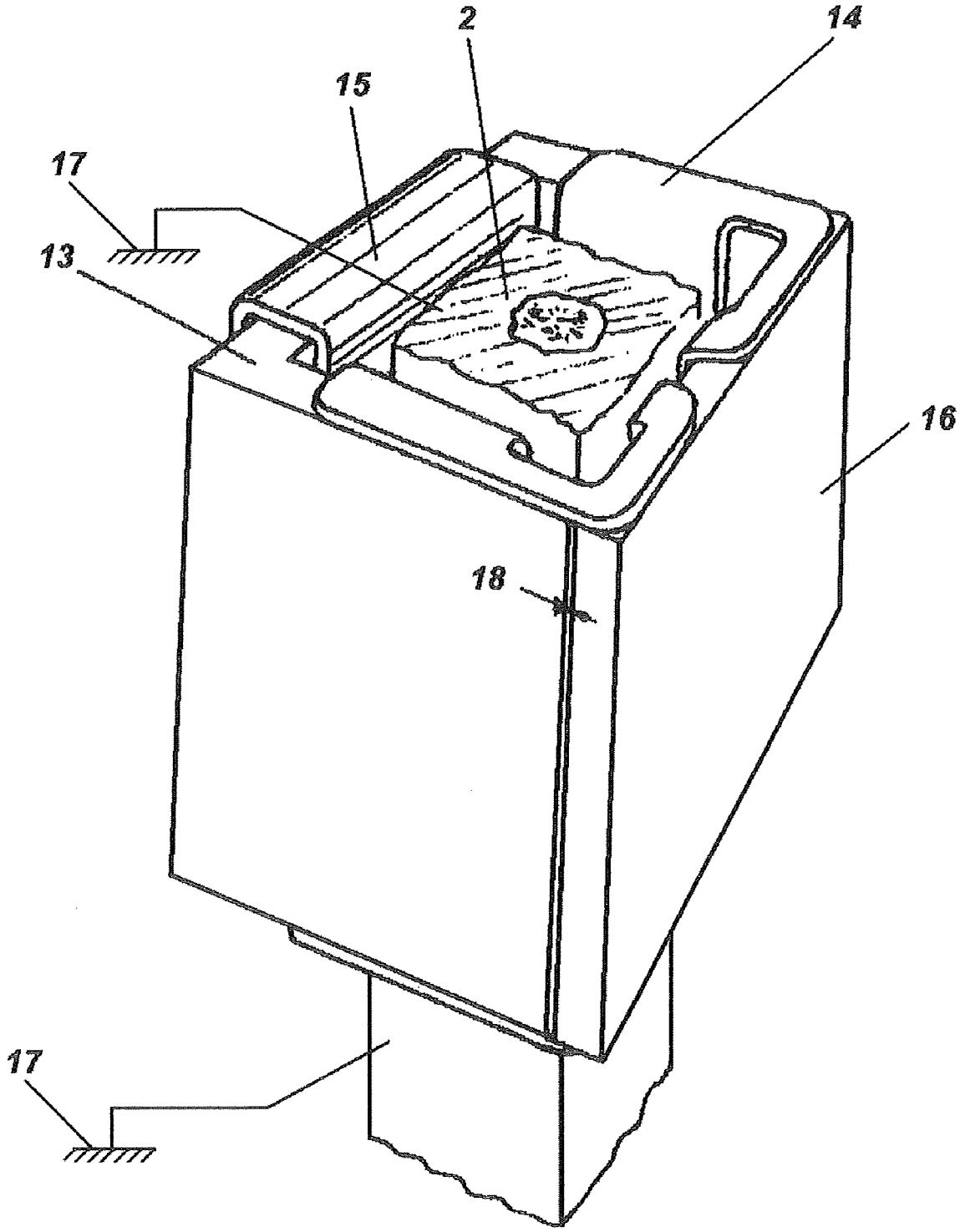
FIG. 8 is a perspective view of a line/final electromagnetic stirrer that realizes the method of electromagnetic stirring according to the invention.

According to the electromagnetic method of stirring in the final solidification zone, the alternating three-phase or two-phase current is to be applied to a set of three coils, shown best in FIG. 8. A first coil, consists of one or two sections an inductor 15 are supported on the one or two of four rods of a rectangular magnetic core 13, which surrounds the continuously casted billet 2, and two second coil magnets 14, having a saddle-shape form, are disposed between the magnetic core 13 and the billet 2. The first coil of inductor 15 generates a magnetic flux, which is confined inside the magnetic core 13, the second two coils 14 (magnets) responsible for pushing out a part of the above-mentioned magnetic flux from magnetic core and imposition it into billet. When all the coils are connected to the system of three-phase or two-phase voltage, the magnetic flux, which is pushing out of magnetic core, is revolving—similar to a non-salient-pole asynchronous motor.

The first coil 15 (inductor), generating the magnetic flux, surrounding the ingot, induces in the billet a longitudinal current that never can be equal to zero in the geometrical and metallurgical center of the ingot.

According to the electromagnetic stirring method of the invention two stirrers are installed along the same cast strand, induce the currents in the cast billet that join together into a common loop that includes the billet and elements of the casting arc. The common current exists between the stirrers and it reaches 10-20 kA. Elements of the longitudinal current flowing through the billet cross section in the liquid portion and in the solid portion interact and as a result of this interaction, strong cross electromagnetic forces appear in both portions of the billet—in the solid portion and in the liquid portion. The cross electromagnetic forces in the liquid portion leads to a flow of the liquid steel or mushy zone. As a result, there is a movement of the molten steel in the ingot and an intensity in the stirring forces. So, as result of induced current existence in the liquid portion of billet, the stirring of the molten steel in the ingot exists even between final stirrers independent from the distance between the stirrers.

In contrast to the conventional asynchronous stirrers, by this phenomenon, the molten steel in the center portion of the molten pool is stirred sufficiently enough to cause a uniform temperature distribution along all the ingot where the stirring effect is present. Thanks to force convection at the interface the increasing of heat transfer and diffusion on the solidification front the non-uniform growth of columnar dendrites is suppressed everywhere, where the induced current exists, and the conditions for segregation development disappear, so that a white band in such a distinctive form as would result from conventional stirring does not occur either.

Referring again to FIG. 1, there is schematically shown the electromagnetic stirring system, which is employed in the method of the invention for use in continuous casting processes of molten medium and high carbon steels. The system of electromagnetic stirring is formed of multiple adjacent stirring elements, namely: the mold single or dual asynchronous stirrer 4, and a two-section stirrer 6, 7 having an intermediate (line) 6 and a final section 7.

The distance between the intermediate 6 and final sections 7 of the two-section stirrer can be as long as the casting ark allows.

Referring to FIGS. 2A and 2B, there is schematically shown that the mold stirrer creates the rotational magnetic flux with four or six electromagnetic coils 5 located on a common magnetic core 4A and, referring to FIG. 3, fed by three-phase or two phase currents from the frequency inverter or from another power supply that generates the multiphase poly-harmonic currents with controlled phase sequences, amplitudes and harmonic structure. A low frequency current component has a direct phases sequence, frequency of f.sub.1=3.0-6.5 Hz, and an amplitude 100%, being dependent on the casted ingot sizes and casting speed. A high frequency (13-20 Hz) component has the reverse phases sequence, and a current amplitude equal to 20-500%. All above mentioned polyharmonic currents periodically changes with frequency equals to 0.5 of intrinsic frequency of the solidifying ingot, billet or bloom and (about 1 Hz for billet 7.times.7 inch of cross section) increases the amplitudes k times, 0.2<k<1.0 and save this value during 1/f.sub.1.

The above-mentioned current structure is determined from a standpoint of using an edge effect for:

a) applying a reverse electromagnetic torque to the meniscus and to suppress a vortex at the meniscus; b) reducing the vertical components of the steel velocity for preventing the entrapment of inclusions in the ingot; c) saving the stirring intensity inside the mold and nevertheless, an opposite torque is applied to the meniscus of the molten steel; d) oscillating with an amplitude of 2 mm the meniscus edges for increasing the flow of molten mold powder into the gap between the mold and the ingot walls; e) providing Joule heating of solidified shell edges with the molten steel for lowering the point of initial solidification by 2 mm for preventing a touching and bending of shell edges during mold oscillates; and f) generation of pulse magnetic pressure, spreading in the liquid portion along of billet as acoustic waves and extending the zone experiencing of the force convection below the mold to a final point of solidification for increasing the stirring effect.

The magnetic system of the dual or single mold stirrer does not differ from regular asynchronous stirrers that provide the rotational motion of the molten steel inside the mold, and, at the same time the reverse electromagnetic torque, as shown in FIG. 5, and the Joule heating and increased oscillation of the meniscus edges, FIG. 7. The magnetic flux of the lowest frequency component easily penetrates into the mold and the ingot.

Referring to FIG. 3, there is the principal electric schematic layout of the polyharmonic current source for the mold stirrer. The logical programmable electronic block, which contains the frequency inverter, forms the control signals for power components that transform the direct current from the rectifier into alternating two- or three-harmonic two-phase or three-phase currents, having the above mentioned or any harmonic consistency, amplitudes and phase sequence. The poly-harmonic currents passing in the coils of the inductor create the magnetic field of the same frequency content.

Referring to FIGS. 4 and 6, an explanation of the edge effect of an asynchronous stirrer is now explained. The magnetic flux, generated in the coils 5 (stator), flows through the copper mold 3 and the steel ingot 2. The magnetic flux meets the electromagnetic resistance in the highly conductive mold 3 and the ingot and as a result induces eddy currents. The eddy currents create their own magnetic flux that prevents the penetration of the primary flux into the mold and the ingot. This results in that the primary magnetic flux tries to avoid the copper mold 3 from above and below. At the mold top, above the meniscus, the magnetic flux meets comparatively low screening and tries to penetrate into the conductive steel ingot 2 through the meniscus. The higher the frequency of the magnetic field component the more the magnetic flux tries to avoid the copper mold 3 and the ingot 2 and thus a greater portion of the magnetic flux penetrates through the meniscus and concentrates on the meniscus edges.

Figure 5B:
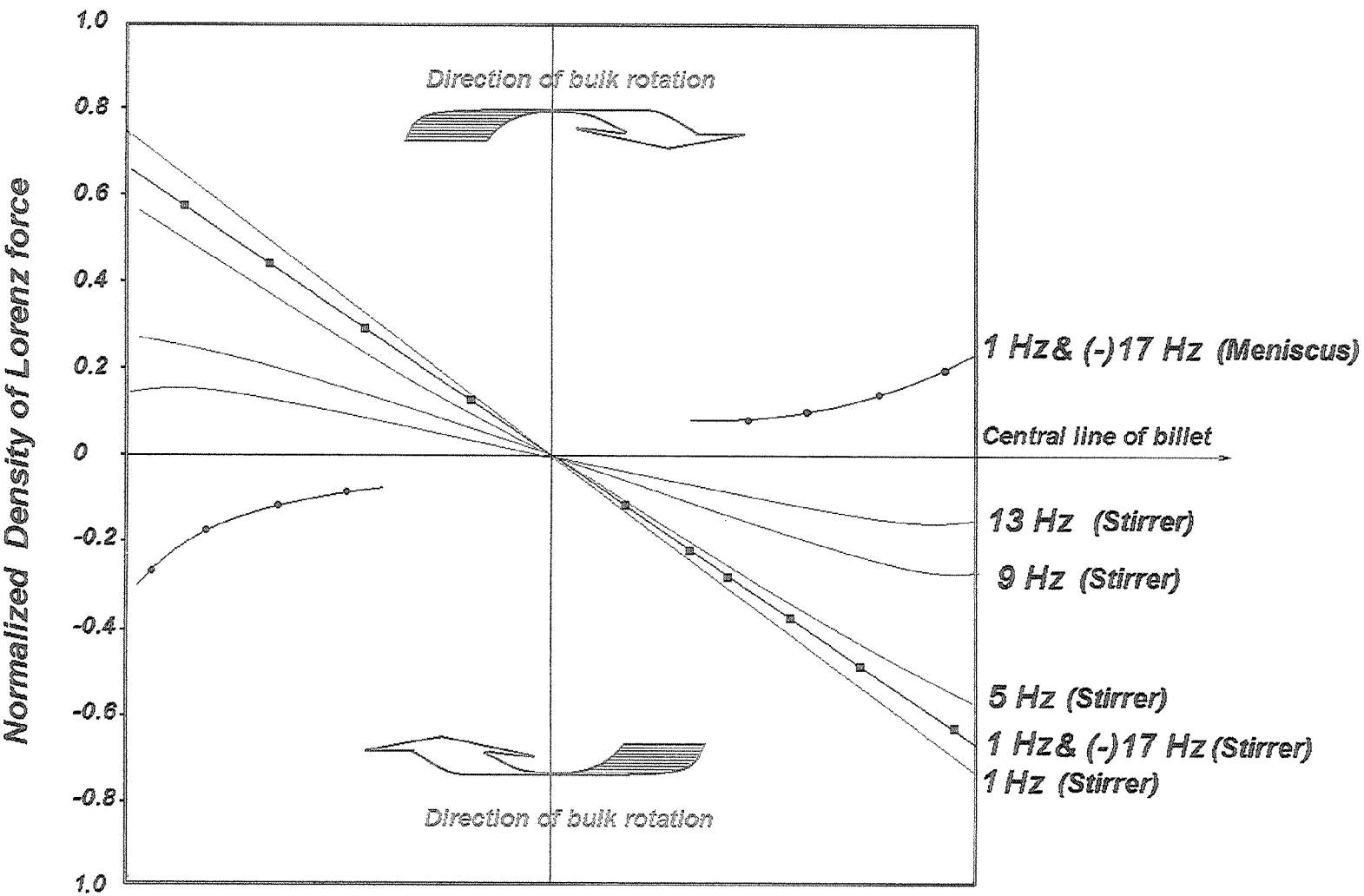

The reverse braking torque is formed because the current of the high frequency component has adjusted with the reverse phases sequence comparatively with the currents of the low frequency component. Referring to FIG. 5A, there is schematically shown a distribution of electromagnetic forces at the meniscus by the different frequencies of the magnetic flux generated by the coils of the stirrer stator including the distribution of electromagnetic forces at the meniscus when the feed current has two frequency components: 3.0 Hz and 17 Hz. At the same time the main stirring effect—revolving electromagnetic forces on the middle of stator of in-mold stirrer are shown in FIG. 5B. Nevertheless, the high component of the magnetic flux creates the reversing torque at the meniscus, the main revolving force in the center section of the in-mold stirrer remains high, so the efficiency of stirring and the possibility of superheating decreasing remains strong too. At the same time the next low frequency current component f.sub.3=0.5 f.sub.intr (about 1 Hz) and amplitude 1.5-2.0 times higher then for current of second frequency component f.sub.2=3/0-6.5 Hz—creates the pressure pulsation with frequency equal to intrinsic frequency of melt oscillation in the liquid portion of ingot. This oscillating pressure spreads along billet and generates the pulse flow at the solidification front.

Referring to FIG. 7 there is schematically shown the formation of meniscus edge vibrations when strong high frequency currents concentrate at the meniscus edges (because of the strong edge effect) and interact with a strong, low frequency magnetic flux. The resulting intensity of the mold powder inflow into the gap between the mold and the ingot increases 15-30% and a heat resistance of the slag scum increases also directly at the point of beginning of solidification.

The concentration of electromagnetic power on the meniscus edges and the simultaneous generation here of the Joule heating together with the increase of heat resistance in slag layer between the mold and the ingot leads to a partial melting of shell edges and a lowering of the point of initial solidification. Referring to FIGS. 6 and 7, there is schematically shown the lowering of the initial solidification at the ingot shell and the prevention of touching of the solidifying ingot with the slag rim above the meniscus, when the mold oscillates.

Referring to Table 1, there is shown the comparison of cinematic characteristics of two asynchronous stirrers with different kinds of feed currents. The electromagnetic mold unit, which is employed in the method of the invention for use in continuous casting of steel billet and bloom, and which is adapted so that the poly-harmonic currents fed to the stirrer magnetic system, leads to the meniscus becoming quiet, and the melt velocity components—azimuth and vertical are suppressed. The resulting suppression of the velocities at the meniscus leads to a decrease of mold powder droplets and particles being entrapped. The intensity of melt stirring decreases on average by 10% when the poly-harmonic current uses the same current amplitude that is used in regular mono-harmonic current.

core 13, the saddle shaped coils 14 are provided for pushing out part of the above-mentioned magnetic flux from the magnetic core 13 and imposition of it into the ingot. The magnetic core 13 is formed of two parts: a first part 12 has a U-shape, the second part 16 is straight. Between the core parts 12 and 16 is an adjustable air gap 18, filled with a dielectric, provided for controlling a ratio between the magnetic flux inside and outside of the magnetic core. When all the coils of the system are connected to a two- or three-phase voltage, the magnetic flux that is pushing out of the magnetic core 12, 16 is jumping similar to a regular asynchronous stirrer. The first coil 15, generating the magnetic flux surrounding the ingot 2, generates here the longitudinal and jumping or revolving current that never can be equal to zero (IRMS.noteq.0) at the geometrical center of ingot, if the ingot has a galvanic contact with elements of the casting arc or is grounded.

Figure 9B:
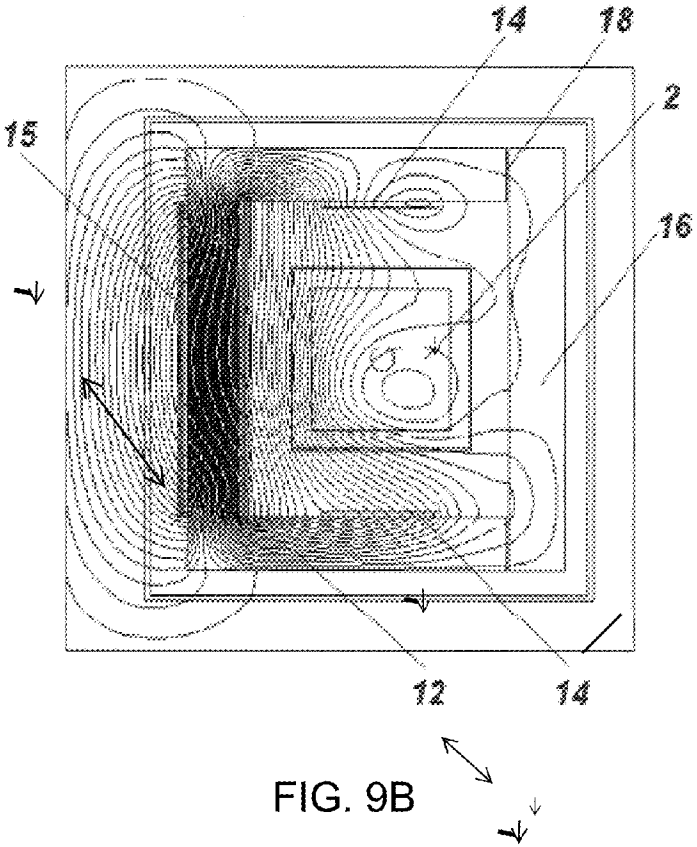
FIGS. 9A and 9B are graphs explaining the effect of ingot grounding on the casting arc and a change of the distribution of magnetic flux density in the ingot.
Figure 9A:
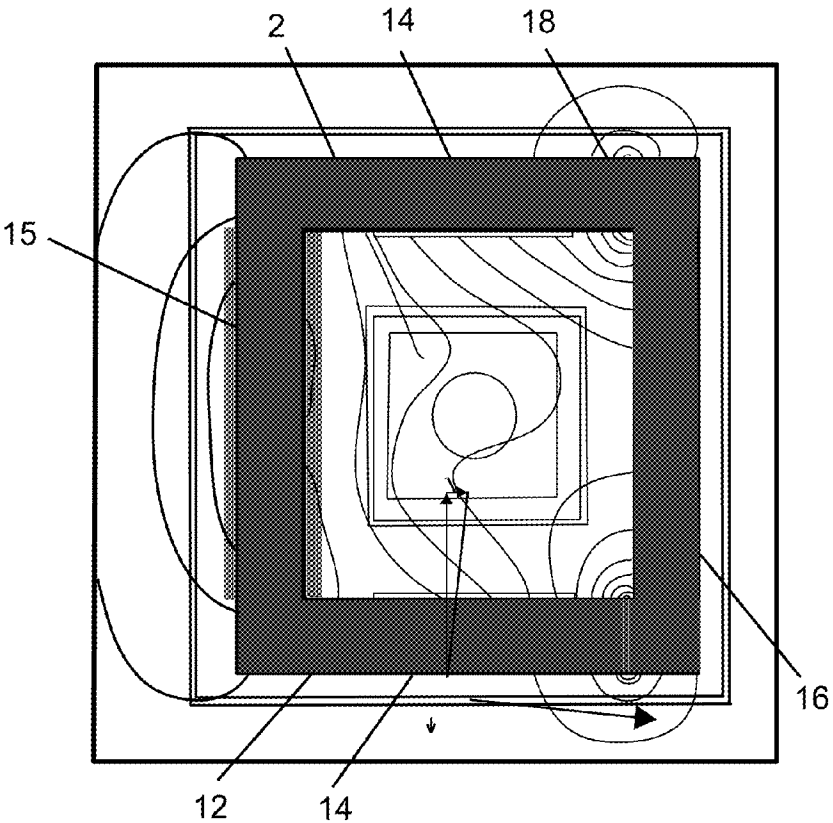

Referring to FIG. 9A, there is shown the superposition of magnetic fluxes generated by the coils 14 and 15 when the ingot does not have perfect contact with elements of the casting arc or is not grounded. This results in that induced currents in the cast ingot remain in the ingot, do not pass out of the ingot, and have different directions relative to an ingot axis, so that a current in the ingot center equals to zero. FIG. 9A shows the case of an asynchronous stirrer, having a zero value for the induced current (IRMS=0) and electromagnetic force in the ingot center.

Figure 11:
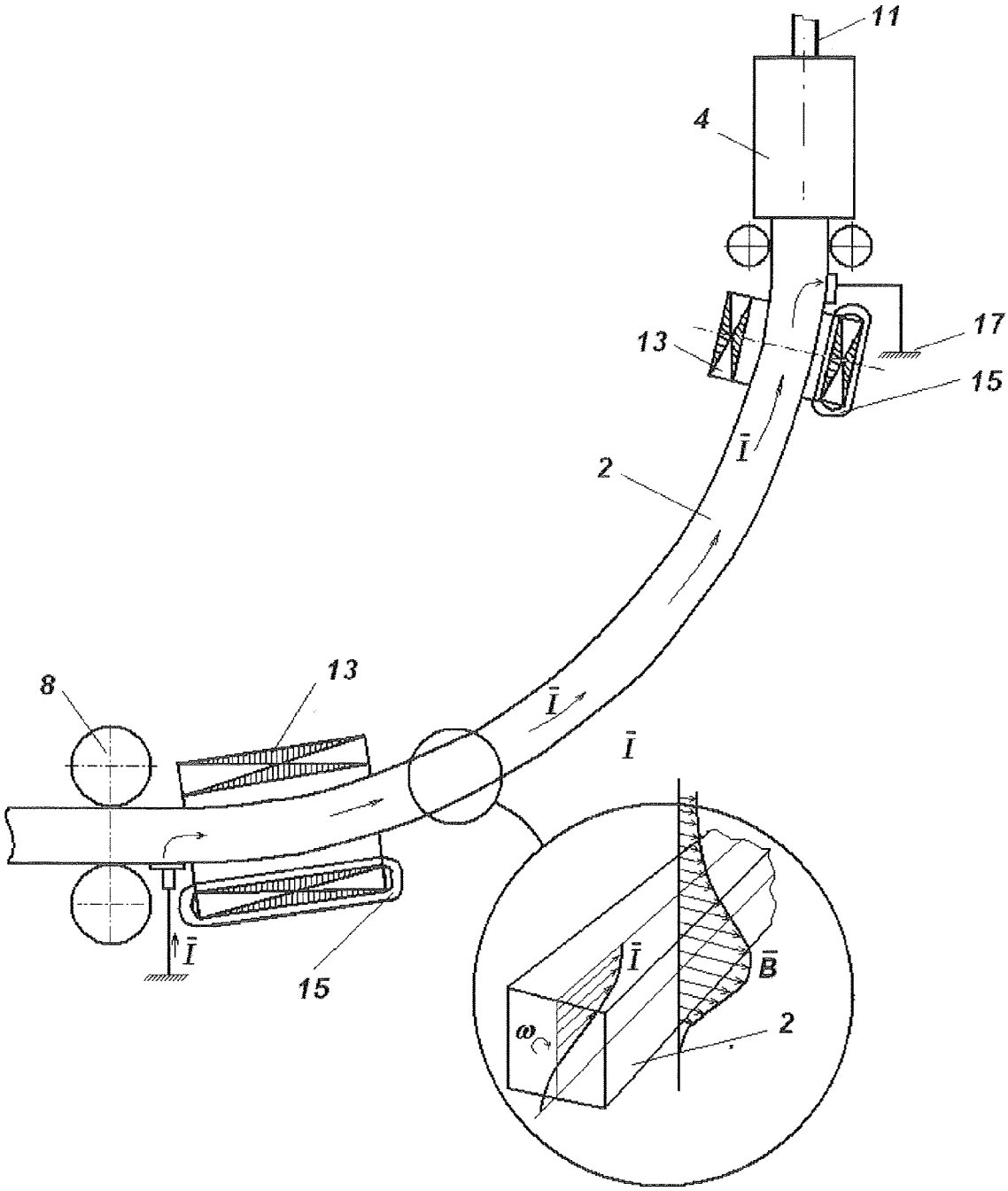
FIG. 11 is a section view for explaining of current and magnetic flux direction in ingot.

Referring to FIG. 9B, there is shown the superposition of magnetic fluxes, generated by the coils 14 and 15 when the ingot has perfect contact with the elements of the casting arc or grounded via connectors 17, see FIGS. 8 and 11. This results in that an induced current in the cast ingot 2 creates a path that goes out of the ingot and through the casting arc embrace of the stirrer inductor and has one direction relative to the ingot axis, and never can equal zero in the ingot center. This case represents the case of a regular transformer, where the ingot plays the role of the single-turn secondary winding and the secondary current of the single direction flows a cross section of the ingot.

TABLE 1

| | Meniscus behavior | | | | | | | | |
|---|---|---|---|---|---|---|---|---|---|
| | Vertical velocity component, m/s | | Radial velocity component, m/s | | | Helical | Melt behavior in stirrer | | |
| Kind of feeding current | Near nozzle max. value | Near mold wall max. value | Near nozzle max. value | Between nozzle and mold wall max. value | Near mold wall max. value | velocity component, m/s max. value | Helical velocity component, m/s max. value | Amplitude of meniscus edge vibration, mm | Ave. helical velocity, m/s |
| Mono, 5 Hz | 0.01 | 0.016 | 0.058 | 0.144 | 0.014 | 0.2 | 0.26 | 2 | 0.1416 |
| Poly, 3&-13 Hz | 0.005 | 0.006 | 0.012 | 0.102 | 0.009 | 0.11 | 0.24 | 4 | 0.1198 |

Referring to FIG. 8, there is schematically shown a line/final electromagnetic stirrer 6, 7 of FIG. 1 in accordance with the invention. According to the electromagnetic method of stirring within a mold or in the final solidification zone, the alternating single-phase, two- or three phase current of mono-harmonic industrial frequency is to be applied to a set of two coils. The first coil 15 is located on the one of four rods of the rectangular magnetic core 13 that surrounds the continuously casted ingot 2, and the second coil 14 having a saddle-shape form and located between the magnetic core 13 and the ingot 2. Both coils 14 can be manufactured as a double coil especially for adjusting the necessary voltage. The first coil 15 generates the magnetic flux that is confined in the magnetic Referring to FIGS. 10A, 10B, there is shown the distribution of induced currents and electromagnetic forces inside the liquid portion of the ingot (a diameter of the liquid portion being 50 mm and an ingot cross section being 178.times.178 mm).

Figure 10A:
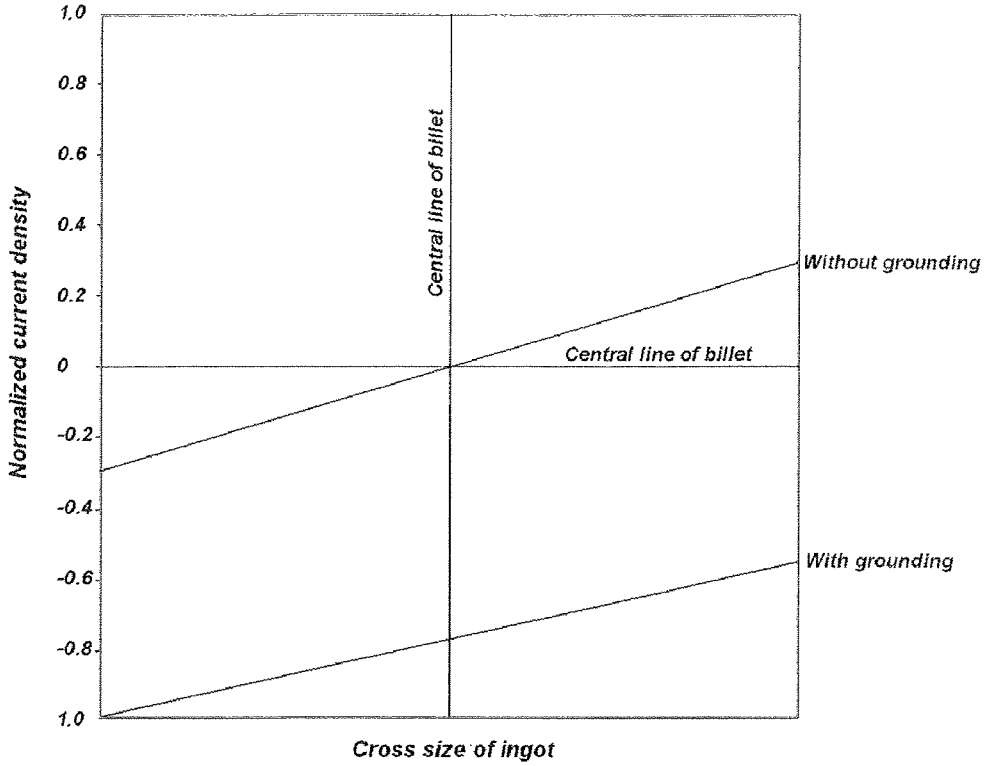
FIG. 10A no grounding, FIG. 10B—grounding.
Figure 10B:
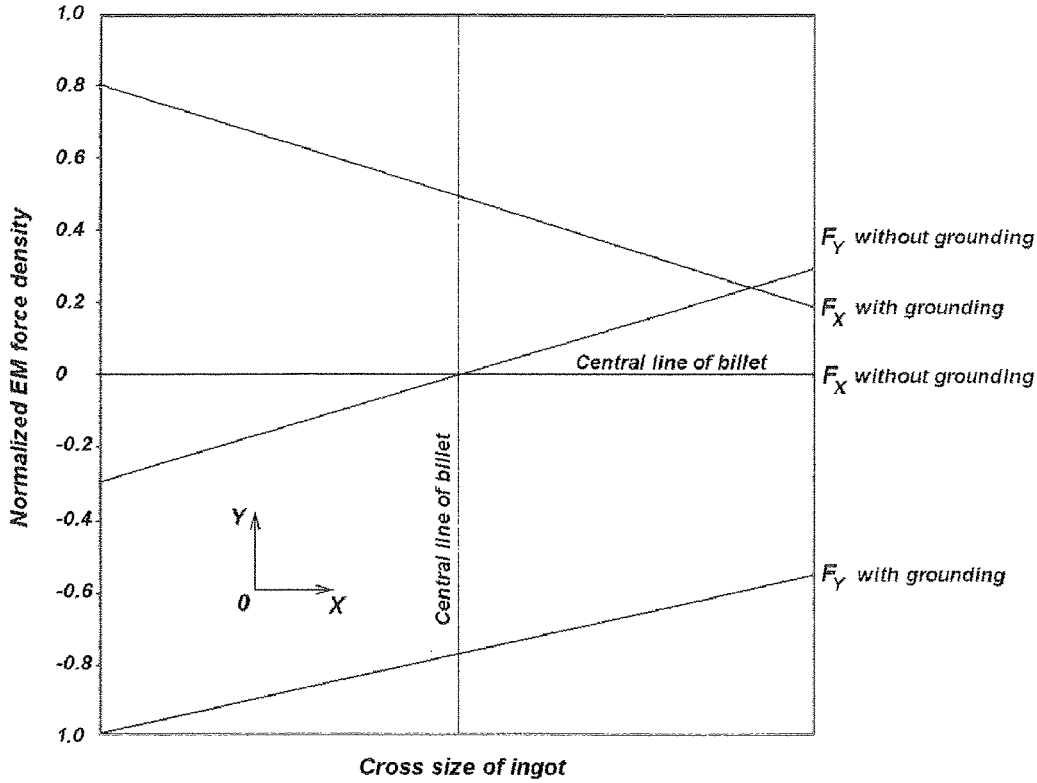

Referring to FIG. 10A, there is shown the distribution of the induced current in the ingot cross section, when the cast ingot has a perfect galvanic contact with elements of the casting arc and does not have a good galvanic contact with elements of the casting arc within the stirrer referring to FIG. 10B, there is shown the distribution of the Lorenz forces in the ingot cross section, when the cast ingot has a perfect galvanic contact with elements of the casting arc within the stirrer and does not have a good galvanic contact with elements of the casting arc within the stirrer. The case of absence of galvanic contact with elements of the casting arc is similar to an open secondary circuit of transformer (no current in the secondary winding) or regular regime of asynchronous motor with a massive rotor—the electromagnetic force equals to zero in the ingot center. The case when ingot has a good galvanic contact with elements of the casting arc before and after the stirrer is similar to a shorted secondary circuit of a transformer—the induced current flows in the same direction though the ingot cross section, including the center of ingot. In this case the electromagnetic force in the billet center does not equal zero, and the level of electromagnetic forces is sufficiently higher than in the case of an "open circuit". This results in a the motion of molten steel in the ingot center, because of the radial component of the electromagnetic force.

Referring to FIG. 11, there is shown how the stirring occurs between the line-line or line-final stirrers. If two similar line stirrers 6, or two line stirrers 6 and one final stirrer 7 are installed on the strand in any combination, and the ingot has a perfect galvanic contact with the casting arc before and after the stirrer groups, induced currents from each of the stirrers join together and obtain a revolving component relative to the ingot axis because of the current induced from the revolving magnetic flux. Interaction of current elements of the above-mentioned revolving loop that flows in the solid (periphery) and liquid (central) portion of the billet leads to the creation of electromagnetic torque inside the liquid (central) portion of the ingot. So the induced currents revolve with the same frequency as the magnetic flux in the inductors of each stirrer and puts the liquid portion of the ingot in rotation. The resulting electromagnetic torque and rotational motion of the molten steel occur in the central portion of ingot between the stirrers independent of a distance between them. Another case of motion of molten steel on the solidification front is the existence here of induced current that concentrates on the apexes of dendrites having higher electric conductivity then liquid steel. Here at the dendrites apexes thanks to interaction of mentioned induced currents with own magnetic field the local electro-vortex flows appear.

Figure 12A:
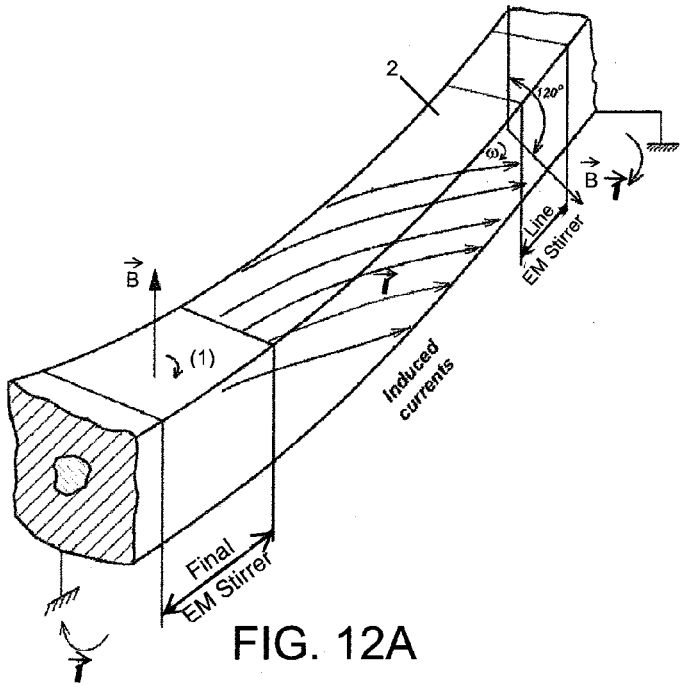
FIGS. 12A, 12B and 12C are a perspective view, a section view and a plan view, respectively for explaining a creation of electromagnetic force in the ingot on the final stages of solidification under the influence of line/final electromagnetic stirrer.
Figure 12B:
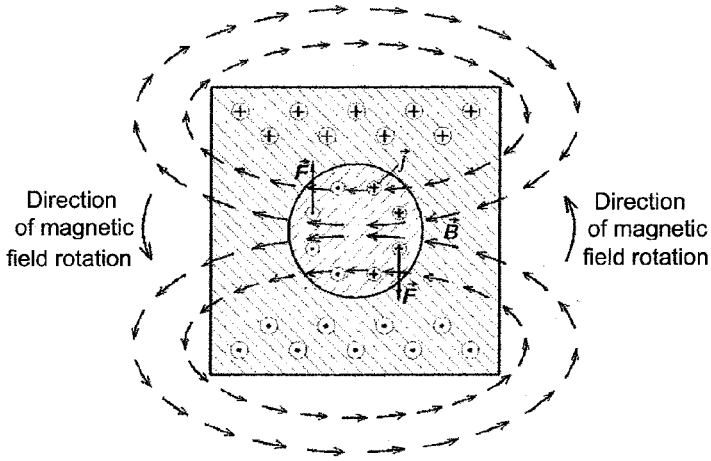
Figure 12C:
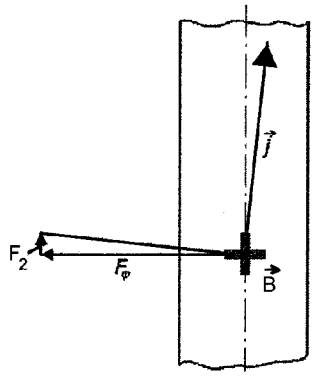

Referring to FIGS. 12A, 12B and 12C, there is shown how a cross (relatively ingot axis) motion of molten steel occurs in the liquid portion of the ingot between the line-line or line-final stirrers. If the inductor 15 and saddle coil 14 of a first neighbor stirrer, installed on the strand, connected to a two-phase voltage system, for example to phases A and B or to three phase voltage system A, B, and C, and the inductor 15 and saddle coil 14 of a second neighbor stirrer, installed on the strand, connected to next two B, A voltage phases if two phase voltage system, and to next B, C, and A if the three phase voltage system. Resulting, the loop of induced currents in the ingot is twisting, see FIG. 12A, obtaining a helical component. The twisting current, flowing inside the solid portion of the ingot along its axis, creates a magnetic flux, shown in FIG. 12B, that induces the current inside the liquid portion of the ingot. As a result of the helical current component and the radial component of the magnetic induction, the axial component of the electromagnetic force and the longitudinal motion of the molten steel occur simultaneously with a revolving motion, see FIG. 12C.

Figures 14A, 14B:
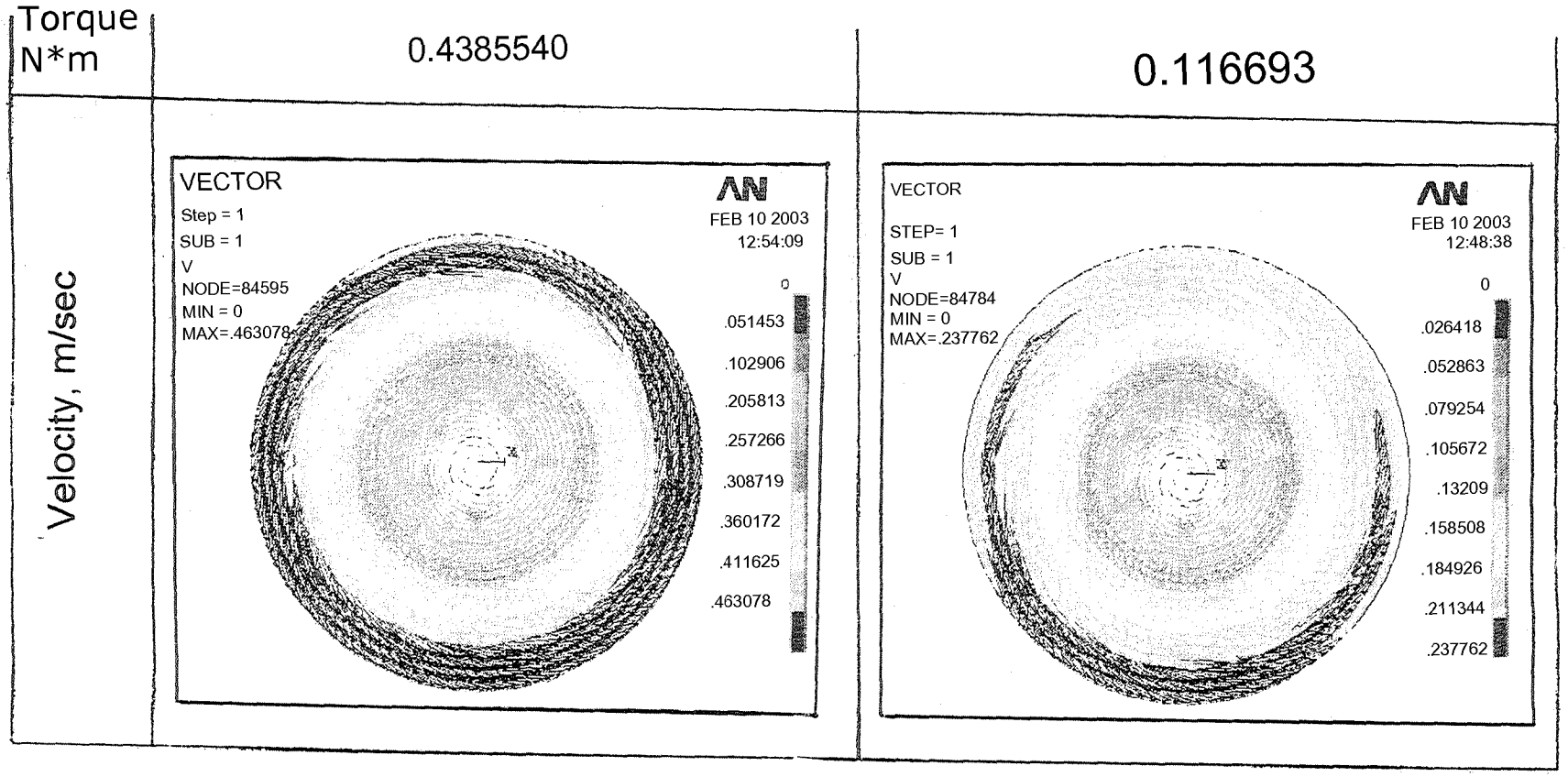
FIGS. 14A and 14B are illustrations showing stirring velocities in the liquid portion of the steel ingot in different cross sections of the ingot in the middle of line/final stirrer (FIG. 14A) and between neighbor line stirrers (FIG. 14B).

Referring to FIGS. 14A and 14B, there is shown the stirring velocities in the liquid portion of the steel ingot in different cross sections of the ingot in the middle of line/final stirrer (FIG. 14A) and between neighbor line stirrers (FIG. 14B). The stirring effect between stirrers remains strong and the maximum velocity decreases only 28% comparatively with the stirrer center. The direction of longitudinal flow of the molten metal depends from sequence of phases of the connection to electric network.

Figure 13A:
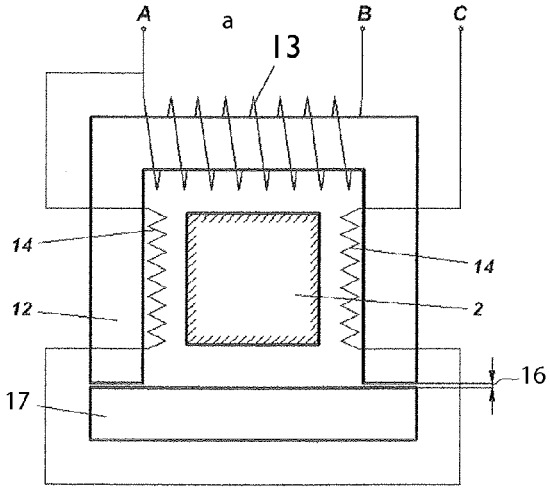
FIGS. 13A-C are illustrations of various electric schemes of line/final electromagnetic stirrer coils connections to the three-phase or single phase voltage system.
Figure 13B:
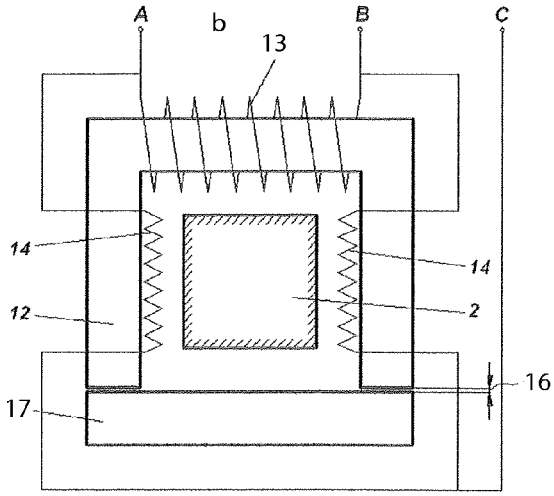
Figure 13C:
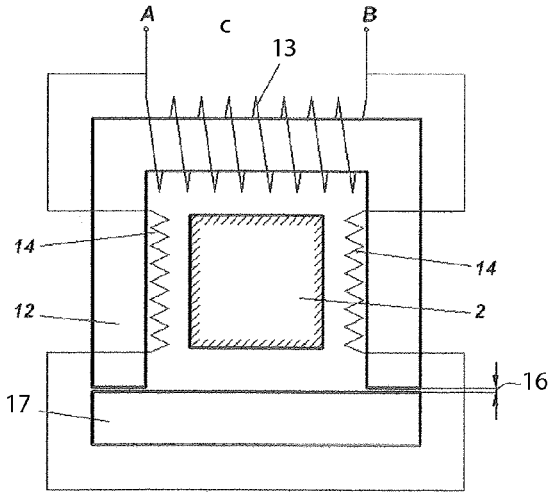

Referring to FIGS. 13A-13C, there is shown the electric schemes coils connections to the single or three phase voltage system of network frequency, when the line or final electromagnetic unit is employed in the present invention. By this phenomenon, the molten steel in the center portion of the molten pool is stirred sufficiently enough to cause a uniform temperature distribution in the interdendritic space which produces a broad equiaxed crystal zone, and, in contrast to the conventional stirring, the conditions of segregation are absent, so a white band in such a distinctive form as would result from conventional stirring does not appear.

The electromagnetic stirring method of the invention was analyzed in comparison with a conventional method in a continuous casting process of 0.58% C steel of a composition containing 1.58% Si, 0.8% Mn, 0.025% P, 0.02% S, and 0.032% Al. The steel continuously cast by a bloom caster, has an ingot size of 300.times.400 mm in section, with a casting speed of 1.25 m/min and superheated to 50.degree. C. for the molten steel in the tundish. The mold electromagnetic stirrer is affected at the poly-harmonic current having a low frequency component f=3 Hz and current amplitude 275 A, and high frequency components of 13 Hz, current amplitude 200 A, reverse phase sequence. For comparison, the same in-mold electromagnetic stirrer is affected at the mono-harmonic current, having frequency 5 Hz and the same current amplitude 275 A. The range of flux density of the magnetic field in the molten steel remains very similar but the distribution of it is significantly different, resulting in the rotational velocity of the molten steel (responses for intensity of inclusions entrapping) decreases from 0.52 m/sec to 0.35 m/sec. Thanks to the vibration of the meniscus edges the mold powder supply into the gap between the ingot and the mold increases on average 15% and the thickness of slag layer increases 15%. Thanks to the increase in the thickness of the slag layer and the thermal resistance of it, the point of initial solidification lowers on average about 3-4 mm and an apex of a solid shell does touch the slag ring located on the internal mold wall above the meniscus. This results in that the shell edges do not bend and oscillation marks at the lateral surface of ingot are greatly reduced.

Thanks to the high frequency component of the magnetic flux and the resultant edge effect at the outlet of the mold, the rotation of molten steel remains and is intensive downstream of the mold to a distance of 1 meter instead of a distance of 0.4 meter when the coils of stirrer energize with a monoharmonic current of frequency 5 Hz. Thanks to the pulse magnetic pressure in the mold the melt motion appears downstream of the mold, the temperature difference between the solid and liquid phases of the ingot decreases and this prevents columnar crystals from growing and further prevents segregation. Therefore, the white bands do not develop because the columnar crystals did not grow.

The invention claimed is:

1. A method of electromagnetic stirring of molten metal in an unsolidified portion of a continuously cast strand of an ingot, which comprises the steps of:

applying an alternating poly-harmonic current to at least four coils of an in-mold stirrer;

supplying the alternating poly-harmonic current with three frequency components, including a first frequency component $f_1$=3.0-6.5 Hz, a second frequency component $f_2$=13-20 Hz, and a third frequency component $f_3$=0.5 $f_{intr}$, where $f_{intr}$ is an intrinsic frequency of the ingot with a liquid portion inside and having a range 0.9-1.2 Hz;

setting a ratio of current amplitudes by equations:

(a frequency current amplitude of $f_2$)/(a frequency current amplitude of $f_1$)=0.5-0.75;

(a frequency current amplitude of $f_3$)/(the frequency current amplitude of $f_1$)=0.2-2.0;

wherein a current of the third frequency component $f_3$=0.5 $f_{intr}$ creates a pressure pulsation with a frequency equal to the intrinsic frequency of melt oscillation in the liquid portion of the ingot, an oscillating pressure spreads along the ingot as acoustic waves that generate a pulse flow at a solidification front;

wherein a current of the first frequency component $f_1$ is a base current and setting the base current in dependence on a size of an ingot cross section for inducing a stirring torque inside the in-mold stirrer for rotation stirring; and wherein a current of the second frequency $f_2$ is provided for reducing a meniscus disturbance, for reducing particle entrapment into the ingot through the meniscus, and for decreasing oscillating marks on the ingot.

2. The method according to claim 1, which further comprises:

providing a unit for intermediate and final electromagnetic stirring of the molten metal downstream of the in-mold stirrer; and generating an alternating magnetic field, the alternating magnetic field including:

a first pulsed magnetic field part; and a second rotating magnetic field part directed substantially perpendicular to an ingot axis and induces in the ingot rotating current loops disposed in a longitudinal section of the ingot.

3. The method according to claim 2, which further comprises providing the unit with a rectangular ferromagnetic core surrounding the ingot for containing the first pulsed magnetic field part around the ingot and preventing magnetic flux leakage avoiding the ingot.

4. The method according to claim 3, which further comprises:

providing two groups of electromagnetic coils to the rectangular ferromagnetic core, the two groups of electromagnetic coils include:

a first coil group surrounding the rectangular ferromagnetic core and creating a first magnetic flux inside of the rectangular ferromagnetic core; and a second coil group having coil groups of two coils each in a saddle-shape form, and disposed between the rectangular ferromagnetic core and the ingot and create a second magnetic flux penetrating into the ingot.

5. The method according to claim 4, wherein the unit includes first and second units for stirring the molten metal and are disposed along the cast strand, the first coil group inducing a current along the ingot that flows between the first and second units for stirring and rotates around the ingot axis.

6. The method according to claim 5, which further comprises using the current flowing along the ingot axis and rotating around the ingot axis for creating an electromagnetic force for stirring the molten metal along from an entry into the first unit up to a final point of solidification.

7. The method according to claim 1, which further comprises: inducing helical and axial components to the molten metal flowing inside a liquid portion of the ingot for preventing large crystal growing and suppression of segregation.

8. The method according to claim 4, which further comprises connecting each of the coils of the first and second coil groups to two of three phases of an AC voltage system operating.

9. The method according to claim 4, which further comprises using the two groups of electromagnetic coils to create in the ingot a rotating vector field of electromagnetic forces, never having a zero in a geometrical center of the ingot.

10. The method according to claim 4, which further comprises using the two groups of electromagnetic coils to create in the ingot a radial component of electromagnetic forces and a motion of the molten metal for preventing an occurrence of segregation.

11. The method according to claim 1, which further comprises applying the alternating poly-harmonic current to six coils of the in-mold stirrer.

12. The method according to claim 1, which further comprises applying the alternating poly-harmonic current to only three coils of the in-mold stirrer.

* * * * *